United States Patent [19]

Bschorr

[11] 4,163,479

[45] Aug. 7, 1979

[54] NOISE ABSORBING DEVICE

[75] Inventor: Oskar Bschorr, Munich, Fed. Rep. of Germany

[73] Assignee: Messerschmitt-Bolkow-Blohm GmbH, Munich, Fed. Rep. of Germany

[21] Appl. No.: 809,173

[22] Filed: Jun. 23, 1977

[30] Foreign Application Priority Data

Jul. 15, 1976 [DE] Fed. Rep. of Germany ..... 2631812

[51] Int. Cl.[2] ..... E04B 1/99

[52] U.S. Cl. ..... 181/286; 181/288

[58] Field of Search ..... 181/258, 281, 288, 293, 181/292, 295, 222, 166, 286

[56] References Cited

U.S. PATENT DOCUMENTS

| | | | |
|---|---|---|---|
| 1,791,232 | 2/1931 | Borkenstein | 181/293 |
| 2,293,181 | 8/1942 | Terman | 181/166 |
| 2,674,336 | 4/1954 | Lemmerman | 181/222 |
| 2,840,179 | 6/1958 | Junger | 181/286 |
| 2,887,173 | 5/1959 | Boschi | 181/286 |
| 3,887,031 | 6/1975 | Wirt | 181/286 |

*Primary Examiner*—Nicholas P. Godici

*Attorney, Agent, or Firm*—W. G. Fasse; W. W. Roberts

[57] ABSTRACT

The present noise absorbing or damping devices are shaped as funnels or horns of various configurations which may be coiled, spiraled, rolled and/or bent or twisted. The open funnel mouth of each funnel faces toward the source of the noise. The volume confined by the funnel walls may be filled with noise absorbing material such as an open cell foam. Preferably at least the funnel neck is filled with such material. A plurality of funnels may be arranged on the walls of a room and the funnel mouths facing into the room may be covered with blankets or mats of noise absorbing material.

13 Claims, 8 Drawing Figures

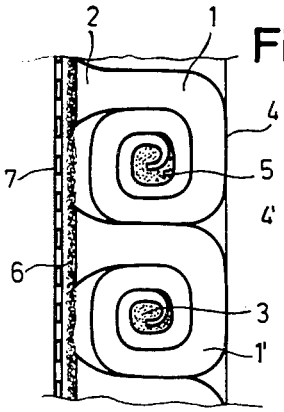
Fig.1
Fig.2
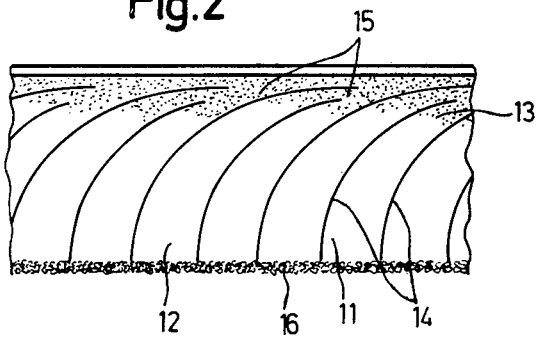
Fig.3
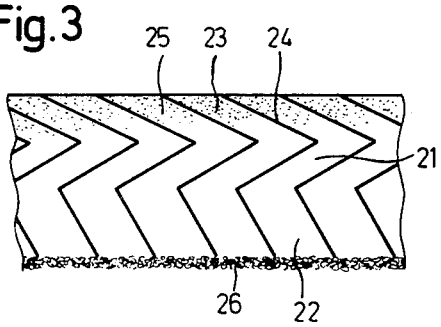
Fig.4
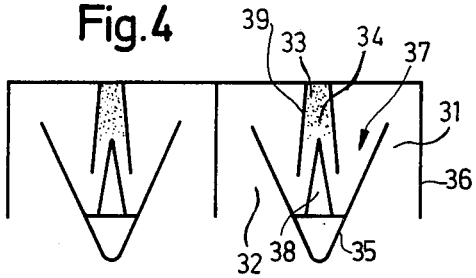
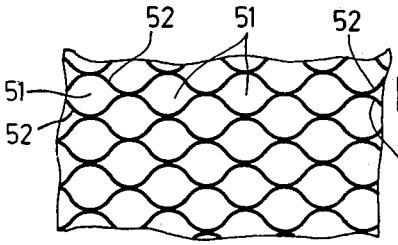
Fig.6
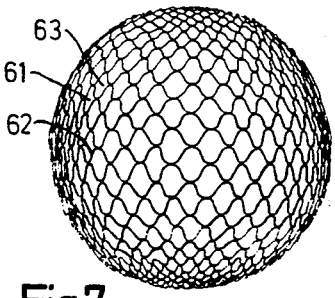
Fig.7
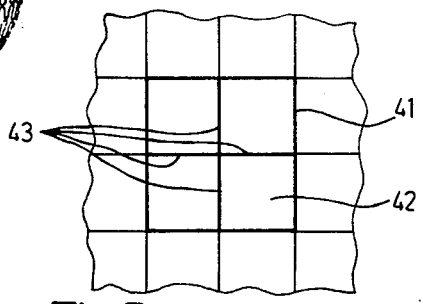
Fig.5
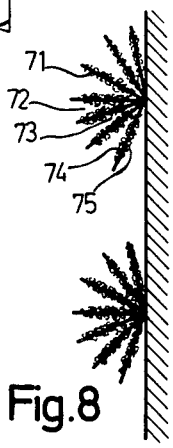
Fig.8

NOISE ABSORBING DEVICE

BACKGROUND OF THE INVENTION

The present invention relates to noise absorbing devices or absorption elements for the damping of noise. A plurality of such devices are arranged on the walls and/or ceilings of halls, rooms, passageways, and channels for soundproofing such spaces.

In order to achieve high noise absorptions which are necessary, for example, in so-called anechoic chambers, it is known to use so-called $\lambda/4$ wedges or so-called Cremer's absorption cubes. Such cubes and wedges are made of absorption material, for example, open cell synthetic foam or rock wool. Both prior art systems provide a sufficient noise absorption above the so-called cut-off frequency. However, the absorption disappears below said cut-off frequency. The cut-off frequency is determined by the length of the wedges which in turn determine the structural depth of the soundproofing means. By "structural depth" in this context is meant the space taken up between a wall of a room and the front face of the soundproofing means facing into the room. Conventionally the structural depth corresponds to $\frac{1}{4}^{th}$ of the cut-off wave length $\lambda$. For example, for a cut-off frequency of 100 Hz the respective wave length in air corresponds approximately to 3.4 m, so that the necessary structural depth corresponds to $3.40 \div 4 = 0.85$ m. This is a substantial space requirement and can frequently not be satisfied, especially by smaller rooms. Although it is possible to lower the effective cut-off frequency with the aid of Helmholtz-Resonators, substantial structural depths are nevertheless still required whereby the available useful space is respectively made smaller.

It is also known to employ absorption mats or blankets as wall and ceiling covers in rooms which do not require the high noise absorption which is required in so-called anechoic chambers. In this type of arrangement the spacing between the absorption mat or blanket and the wall again determines the absorption factor. Mats or blankets which are secured to the wall without intermediate space are not capable of damping the lower and intermediate frequencies. As a result, even such mats or blankets also require relatively large structural depths comparable to the above mentioned $\lambda/4$ condition.

OBJECTS OF THE INVENTION

In view of the above, it is the aim of the invention to achieve the following objects, singly or in combination:

to overcome the drawbacks of the prior art and to provide noise absorption elements or devices which are equally effective for damping the propagation of noise in air as well as in water and other gaseous, vaporous, or liquid media;

to provide noise absorption elements which require a relatively small structural depth while nevertheless providing a high noise absorption even at the lowest frequencies;

to minimize the quantity of absorption material required for the intended purpose;

to provide noise absorbing devices which will require approximately only $\frac{1}{3}^{rd}$ of the volume heretofore required by the so-called $\lambda/4^{th}$ wedges; and to combine noise absorption material with the present noise absorbing elements in such a manner that the cut-off frequency is further reduced or lowered.

SUMMARY OF THE INVENTION

According to the invention, there is provided an absorption element or device in the form of a tapering funnel or horn having a large cross sectional area forming the so-called funnel mouth and a funnel neck opposite the mouth, whereby the funnel mouth is adapted to face the source of the noise to be dampened.

In order to reduce the structural depth and to save damping material the invention teaches constructing the funnels so as to have a spiral or rolled up or bent or twisted shape. The inner volume confined by the funnel walls may be wholly or partially filled with absorption material. Where the cross sectional area of the funnel or funnels has, for example, an exponential configuration and if additionally any so-called dead or unused volume is avoided, one may achieve a structural depth which is theoretically equal to $\lambda/4\lambda$, whereby $\lambda$ again is the wave length of the cut-off frequency. In this manner the structural volume of the sound absorbing means is reduced to $\frac{1}{3}^{rd}$ of the volume necessary where $\lambda/4$ wedges are used for soundproofing a room.

BRIEF FIGURE DESCRIPTION

In order that the invention may be clearly understood, it will now be described, by way of example, with reference to the accompanying drawings, wherein:

FIG. 1 is a schematic sectional view through a wall structure having attached thereto funnel means according to the invention rolled up in the shape of a spiral;

FIG. 2 is a view similar to that of FIG. 1, but illustrating a plurality of funnels with a bent configuration;

FIG. 3 is a sectional view with a plurality of zigzag shaped funnels arranged in parallel to each other, whereby each individual funnel is folded into the desired shape;

FIG. 4 shows a plurality of individual funnels arranged in groups whereby the funnels of a group are arranged in series with each other;

FIG. 5 shows the top plan view of a plurality of funnels which are twisted into the plane of the drawings, or rather perpendicularly thereto;

FIG. 6 illustrates a plurality of funnels arranged in a linear fashion;

FIG. 7 shows a plurality of funnels arranged in a spherical or hemispherical configuration; and FIG. 8 illustrates a further embodiment wherein the funnels are arranged in the manner of a fan.

DETAILED DESCRIPTION OF PREFERRED EXAMPLE EMBODIMENTS

FIG. 1 shows a sectional view through a wall covered with noise absorbing devices according to the invention. Only two noise absorbing funnels 1 and 1' are illustrated. A plurality of such funnels will be used in actuality. Each funnel 1, 1' has a funnel mouth 2 and a funnel neck 3. These funnels are coiled up into a spiral and a portion 4 of the funnel forming wall is secured to the wall 4' which forms part of the room or chamber that is to be soundproofed. The funnels may be made of sheet metal, plastics material, foam materials, foils, ceramic and so forth. Each funnel mouth 2 in the embodiment of FIG. 1 faces toward the noise, namely, the left hand side in FIG. 1. Absorption material 5 such as an open cell foam material is placed inside the space confined by the funnel walls. Preferably, the sound absorbing material 5 occupies the space inside the funnel forming the funnel neck 3. The open mouths 2 of the funnels may be covered by a sound absorbing blanket 6, for example, of felt, cork or the like. An apertured cover panel 7 is placed in front of the sound absorbing blanket 6, if desired.

As seen in FIG. 1, the total surface area of the funnel mouths 2 may take up only a proportion of the entire wall surface. For example, a 50/50 ratio may be suitable. In addition, the spiraling or coiling illustrated in FIG. 1 minimizes the proportion of dead space relative to the total space required for the installation of the sound absorbing devices. Incidentally, the structural depth is measured substantially between the panels 7 and the wall 4'.

The sound absorbing mat 6 has the advantage that even for the upper limit frequencies it is not necessary to make the surface area of the funnel mouths 2 too small. The mat 6 absorbs especially the shorter wave components of the noise to be deadened when these shorter wave components are reflected by the funnel wall. It has been found to be satisfactory to place the sound absorbing material 5 only near the neck 3 of each funnel, whereby substantial quantities of sound absorbing material 5 may be saved while still achieving satisfactory sound deadening results.

The arrangement of FIG. 1 operates as follows. A sound wave entering at the funnel mouth is concentrated into a smaller cross section at the funnel neck 3. Thus, the absorption material 5 in the neck portion 3 of each funnel is utilized more efficiently. Besides, less sound absorbing material is necessary. Another advantage of the invention is seen in that the rolled up or coiled funnel 1, 1' has a lower cut-off frequency than the $\lambda/4^{th}$ cut-off frequency of a wedge. Thus, it is possible to accomplish structural depths with the damping elements according to the invention, which correspond to $\lambda/4\pi$ provided that the tapering of the cross section follows an exponential function and that no dead space is formed. In the embodiment of FIG. 1 the funnels are spiraled and arranged so that the surface area of the funnel mouth 2 takes up only a proportion of the entire surface area taken up by each element. In this manner it is possible to reduce the structural depth where that is desirable and the degree of absorption may somewhat be diminished.

FIG. 2 shows a sectional view through a further embodiment of a plurality of funnels arranged and constructed according to the invention in order to reduce the total square area of material needed to form the funnel walls. Thus, FIG. 2 shows that two or more funnels merge with their necks into a channel which further tapers as illustrated. Two or more of such channels may further merge into each other, however, from a practical point of view, especially with regard to the manufacturing considerations, the funnel cross sectional area or the cross sectional area at the funnel mouth should not be reduced below a certain minimum. Thus, it is simpler to maintain the tapering of the cross sectional area small and hence the cross sectional areas substantially the same. The length of the funnel neck depends on the desired absorption. The neck length is to be selected so that a matching free of reflections is accomplished to absorb the entire sound wave entering into the funnel.

In FIG. 2 the funnels 11 are formed by wall strips or sections 14 which are bent in accordance with the just mentioned considerations namely, to leave the cross sectional area of the funnels substantially the same except in the neck region. Here again the funnel mouths 12 are covered by a sound absorbing blanket 16. Additional sound absorbing material 15 is placed in the neck areas 13. Adjacent wall strips 14 have different lengths so that the respective neck areas merge into each other, whereby wall material may saved. Even more wall material may be saved by merging the funnel necks 13 into channels having a substantially square cross sections. In such an embodiment the ratio of wall material to channel cross sectional area is most efficient. This particular embodiment may be realized by further subdividing the funnel necks by bent spacer members not shown for simplicity's sake. The same effect of saving wall material may be achieved by making the wall between two adjacent walls near the funnel mouths 12 shorter while extending the funnel necks 13 with wall strips bent at a right angle as shown in FIG. 2.

The damping material 15 in the area of the funnel necks 13 is preferably so arranged that its damping effect increases in the direction in which the funnel necks narrow down in their cross sectional area. In this manner the cut-off frequency may be further reduced. This type of damping effect or damping increase may, for example, be accomplished by packing the sound absorbing material 15 more densely as the funnel neck narrows. A similar effect may be achieved by providing the funnel walls with sound absorbing material, for example, as shown at 75 in FIG. 8, whereby again a relative increase in the damping is accomplished as the funnel neck tapering increases.

Incidentally, in connection with the above mentioned arrangement illustrated in FIG. 1 wherein the cross sectional areas of the funnel mouths 2 take up about 50% of the total wall surface area, it is theoretically possible to reduce the mentioned $\lambda/4\pi$ structural depth still further to $\lambda/8\pi$. This type of arrangement is perfectly satisfactory where a reduced absorption is sufficient.

The arrangement according to FIG. 3 is constructed similar to that of FIG. 2. The individual funnels 21 are bent or folded in zigzag shape. To accomplish this configuration the wall sections 24 are bent over several times in different directions as shown. The individual wall strips 24 may be further subdivided by spacer strips bent in the same manner but not shown for simplicity's sake. The mouth areas 22 are again covered by a sound absorbing blanket or mat 26. Absorption material 25 is located in the area of the funnel necks 23.

FIG. 4 illustrates an embodiment of the invention wherein groups of funnels are formed and the funnels of one group are arranged in series with each other so to speak. Thus, a first funnel 31 is formed by the outer wall of a cone shaped member 35 and a wall portion 36. A second funnel 37 is formed by an inner cone member 38 and the inner wall of the cone member 35. A third funnel 39 is arranged so that the inner cone member 38 may reach into the funnel 39. The neck 33 of the funnel 39 is filled with sound absorbing material 34. The mouth 32 of the funnel 31 faces again toward the noise which must be pictured below the illustration of FIG. 4. The neck of the funnel 31 merges into the mouth of the funnel 37 and the neck of the funnel 37 merges into the mouth of the funnel 39. This type of funnel arrangement is known as such in loud speakers. However, in a loud speaker arrangement the direction of sound travel would be opposite to the one here intended.

FIG. 5 illustrates an embodiment in which, for example, four funnel sections 41 separated by intermediate walls 3 are twisted into helical spirals. The spiral shape results from the fact that each funnel section 41 tapers toward its neck perpendicularly to the plane of the drawing. Thus, this tapering is not shown. The helical shape results from the twisting of the tapering funnel sections about each other. Preferably, the number of twists or rather turns increases as the spacing from the funnel mouth 42 increases. Wall material may be saved by further subdividing the spaces between the intermediate walls 43 in order to achieve a funnel cross section which is as square as possible. Here again, the funnel necks may be filled with absorption material not shown.

FIGS. 1 to 5 illustrate embodiments of the invention suitable for covering surface areas whereas the embodiment of FIG. 6 may be suitable as a line sound absorbing element if one visualizes a row of funnels 51 formed between two adjacent corrugated wall members 52. These wall members 52 are made of flexible material and are secured to each other, for example, at spaced intervals by an adhesive. Several such wall members 52 may thus be connected to each other in the manner of a garland and if a stretching force is applied perpendicularly to the longitudinal extension of the wall members 52, the funnels 51 are formed. The wall members 52 are, for example, circular discs, the corrugations of which extend radially. Incidentally, the corrugations need not be formed in a separate production step. It is sufficient to glue the wall members 52 to each other at spaced intervals along radially extending lines and then pulling the so glued wall members apart, whereby the wedge shaped funnels 51 are formed. The funnel necks adjacent to the center of the circular discs may again be filled with absorption material not shown in FIG. 6. It is suitable that the funnel necks are not closed off but are kept open or are arranged to merge into respective channels such as are shown at 15, for example, in FIG. 2.

FIG. 7 illustrates the arrangement of the embodiment of FIG. 6 in a spherical or hemispherical configuration, whereby the funnels 61 are formed substantially in the same manner as the known spherical garlands by using circular or semicircular discs 62 which are glued together along radially extending lines displaced relative to each other from plane to plane as explained above with reference to FIG. 6. Here again the funnel mouths 63 would face toward the source of the noise while the spaces adjacent to the funnel necks would also be filled with sound absorbing material.

FIG. 8 illustrates an embodiment in which the funnels 71 are formed in the manner of a foldable fan, whereby the funnel mouths 72 again opens toward the source of the noise and whereby the funnel necks 73 may be secured to a wall or ceiling or the like. The funnel walls 74 are, for example, plane strips of material which may be covered on their surfaces with sound absorbing material 75. The funnels 71 need not necessarily have a wedge shape. The shape of the funnels will depend on the manner in which the flexible material of the funnel walls 74 is folded. For use the several funnels may be opened in the manner of a fan which is then attached to the wall surface to be soundproofed or damped.

It is an advantage of the invention that it is not necessary to strengthen the walls of the funnels in any particular way because the pressure fields in adjacent funnels are practically in phase with each other, whereby the pressures on the funnel walls, especially those resulting from noise of long wave length, compensate each other. On the other hand, the wall insulation or strength is larger for high frequency, short sound wave lengths. Where the funnels have substantially circular cross sectional areas the dimensional stability is substantial and as a result extremely thin foils may be used to make the funnel walls. In addition, funnel walls which vibrate with the noise waves contribute to the damping effect.

Incidentally, according to the invention, the individual funnel members need not all have the same configuration, rather, individual funnels may have different configurations and may be tuned to different, for example, lower frequencies. Thus, it is possible to extend the absorption into the lower frequency range without substantially increasing the structural depth.

Although the invention has been described with reference to specific example embodiments, it will be appreciated, that it is intended to cover all modifications and equivalents within the scope of the appended claims.

What is claimed is:

1. A noise absorbing device having a given cut-off frequency with a wavelength $\lambda$ comprising horn means including a plurality of horn members each having large cross sectional area mouth means and small cross sectional area neck means as well as tapering horn wall means interconnecting said mouth means and neck means, said horn means being adapted to face with said mouth means toward the noise, said horn wall means having a given straight length, said horn wall means further comprising means reducing the structural depth of said horn means, as compared to said given straight length, said structural depth reducing means comprising bends in said horn wall means, said bends being uniformly shaped so that said plurality of horn members may be nested one next to the other.

2. The noise absorbing device of claim 1, further comprising noise absorbing material in at least part of the space confined by said horn wall means.

3. The noise absorbing device of claim 2, wherein said neck means of said horn means is filled with noise absorbing material.

4. The noise absorbing device of claim 1, wherein said horn means comprise a configuration which maximizes the utilization of space.

5. The noise absorbing device of claim 1, further comprising blanket means of noise absorbing material arranged to cover said large cross sectional area horn mouth means.

6. The noise absorbing device of claim 1, wherein said plurality of individual horn members have configurations at least some of which differ from each other.

7. The noise absorbing device of claim 1, wherein individual ones of said horn members are tuned to a lower cut-off frequency than other individual horn members.

8. The noise absorbing device of claim 1, wherein said horn wall means are made of sheet material.

9. The noise absorbing device of claim 1, further comprising noise absorbing material in at least part of the space confined by said horn wall means, said noise absorbing material having a packing density which increases with the increasing tapering of said horn means, whereby the damping effect increases with the increasing packing density, and whereby the cut-off frequency is further reduced.

10. The noise absorbing device of claim 1, further comprising noise absorbing material secured to said horn wall means.

11. The noise absorbing device of claim 1, wherein said horn wall means are arranged so that every other wall means of a group of horn members is shorter than the two wall means next adjacent the shorter wall means.

12. The noise absorbing device of claim 1, wherein said bends of said horn wall means extend at an angle relative to each other.

13. The noise absorbing device of claim 12, wherein each of said walls has two angular bends.

* * * * *